US009309617B2

(12) United States Patent
Buso et al.

(10) Patent No.: US 9,309,617 B2
(45) Date of Patent: Apr. 12, 2016

(54) HOME APPLIANCE HAVING DETERGENT COMPARTMENT

(75) Inventors: Danny Buso, S. Quirio (PN) (IT); Pietro Rizzetto, S. Stino di Livenza (VE) (IT)

(73) Assignee: Electrolux Home Products Corporation N.V., Brussel (BE)

( * ) Notice: Subject to any disclaimer, the term of this patent is extended or adjusted under 35 U.S.C. 154(b) by 1086 days.

(21) Appl. No.: 13/390,053

(22) PCT Filed: Aug. 10, 2010

(86) PCT No.: PCT/EP2010/061598
§ 371 (c)(1),
(2), (4) Date: Apr. 23, 2012

(87) PCT Pub. No.: WO2011/018452
PCT Pub. Date: Feb. 17, 2011

(65) Prior Publication Data

US 2012/0204606 A1 Aug. 16, 2012

(30) Foreign Application Priority Data

Aug. 12, 2009 (EP) ..... 09010369

(51) Int. Cl.
*D06F 39/02* (2006.01)

(52) U.S. Cl.
CPC ..... *D06F 39/02* (2013.01)

(58) Field of Classification Search
CPC ..... D06F 39/02; D06F 39/022; D06F 39/024; D06F 39/026; D06F 39/028
USPC ..... 134/93; 68/17 R
See application file for complete search history.

(56) References Cited

U.S. PATENT DOCUMENTS 3,406,876 A * 10/1968 Steele et al. ..... 222/630
D232,187 S * 7/1974 McCollum ..... D32/25

FOREIGN PATENT DOCUMENTS

EP 0 582 092 2/1994
GB 1 289 412 9/1972

(Continued)

OTHER PUBLICATIONS

Chinese Office Action issued on Mar. 5, 2014 in corresponding Chinese Application No. 201080043107.4.

(Continued)

*Primary Examiner* — Michael Barr
*Assistant Examiner* — Rita Adhlakha
(74) *Attorney, Agent, or Firm* — Banner & Witcoff, Ltd.

(57) ABSTRACT

The invention relates to a home appliance, in particular washing and/or drying machine (1), comprising a detergent feeding device (2) having at least one detergent storing compartment (4) for storing a detergent, the at least one detergent compartment (4) comprising: an outlet (12) for a detergent and water mixture, and a pivoted partition element (14) arranged in the detergent compartment (4), wherein in a first position the partition element (14) separates a partial compartment (34) in the detergent compartment (4) from the outlet (12) for storing an amount of liquid detergent in the partial compartment, and wherein in a second position the partition element (14) provides passage from the partial compartment to the outlet (12). According to the invention in the first position the partition element (14) is inclined with respect to the bottom (6) of the detergent compartment (4), such that from the first position the partition element can be pivoted to the second position only in one pivoting direction and wherein the pivoting path of the partition portion (16) of the partition element (14) from the first to the second position is partially situated in the partial compartment (34). According to another embodiment of the invention the pivoted partition element (60) has a single pivot rest (62, 64) arranged at the bottom (58) of the detergent compartment (56).

9 Claims, 4 Drawing Sheets

(56) References Cited

FOREIGN PATENT DOCUMENTS

| | | | | |
|---|---|---|---|---|
| GB | 1558182 | * | 9/1975 | ..... A47L 15/44 |
| GB | 2187763 | | 9/1987 | |
| KR | 10-2005-0045258 | | 5/2005 | |
| KR | 10-2005-0047424 | | 5/2005 | |
| WO | 2005/106101 | | 11/2005 | |

OTHER PUBLICATIONS

International Search Report issued in corresponding International Application No. PCT/EP2010/061598, mailed Dec. 17, 2010.
Extended European Search Report issued in corresponding European Application No. 09010369.8, dated Jan. 26, 2010.

* cited by examiner

HOME APPLIANCE HAVING DETERGENT COMPARTMENT

BACKGROUND OF THE INVENTION

The invention relates to a home appliance, in particular to a washing and/or drying machine, having a detergent feeding device comprising at least one detergent storing compartment for storing a detergent, wherein the detergent storing compartment can be used for storing of a solid (powder) detergent and for storing a liquid detergent.

KR-A-10-2005-0047424 discloses a washing machine having a detergent feeding device and therein three detergent compartments. One of the compartments has a pivotable supported partition member that can be swung between an open and a closed position. In the closed position a partial compartment is formed within the detergent compartment and liquid detergent can be stored in the partial compartment. When the partition member is swung aside, powder detergent can be filled into the detergent compartment. Two bearings are provided in the detergent compartment for pivotably mounting the partition member, which has a vertical pivoting axis.

KR-A-10-2005-0045258 proposes another detergent feeding device having one detergent compartment with a partition member for switching between liquid detergent supply and powder detergent supply. Within the detergent compartment the partition member can be moved between a middle position and a rear position. The partition member has two protruding pins at its lateral upper sides that extend into guiding grooves formed on both lateral side walls of the detergent compartment. From the rear position to the middle position the partition member can be moved by lifting the partition member guided along a downward extending rear end of the guiding groove, moving the partition member to an elevated middle position by a horizontal parallel movement within the guiding grooves, and then lowering the partition member at the middle position within downward extending ends of the guiding grooves. In its lowered middle position the lower edge of the partition member rests at a stop arranged at the bottom surface of the detergent compartment just behind the lower edge of the partition member so as to prevent the partition member from swinging to the backside and releasing thereby the liquid detergent.

SUMMARY OF SELECTED INVENTIVE ASPECTS

It is an object of the invention to provide a home appliance comprising a detergent feeding device having therein a detergent storing compartment, having simple constructive measures for switching between solid detergent use and liquid detergent use. In particular the simple measures are effective in use by a user and/or when manufactured.

According to claim an aspect of the invention, a home appliance, in particular a washing machine or a dryer, is provided having a detergent feeding device. The detergent feeding device is for example a detergent drawer as used in washing machines or it may also be a fixed feeding device which is for example arranged at the upper region of the home appliance. In the latter case, the detergent feeding device can be accessed (i.e. can be filled with detergent) through an upper opening (for example an opening covered by a flap, a cover or the like). In a dryer, dry cleaning agent can for example be stored in the detergent feeding device. The term detergent' may include any washing or cleaning or refreshment detergent agent, for example a deodorizer, a washing detergent, a softener, a softening agent, a fabric softener, a fragrance agent, a disinfect agent and the like.

According to a first embodiment, a partition element is pivotably arranged in the detergent compartment and has a horizontal or essentially horizontal axis (essentially horizontal e.g. being within a range of equal to or less than +/−100 or +1-5° to the horizontal line). In a first position the partition element separates a partial compartment within the detergent compartment so that by the partition element the filling volume that is laterally confined by the partition element in the first position is smaller than the filling volume of the detergent compartment as such (with the partition element in the second position). Also the partition element prevents a lateral flow of liquid detergent towards the outlet of the detergent compartment (or at least substantially prevents the outflow of liquid detergent to the outlet—see embodiment of the intentional leak as described below). In a second position of the partition element the lateral confinement to the partial compartment within the detergent compartment is removed and the detergent (liquid as well as solid detergent) may flow to the outlet of the detergent compartment.

According to an embodiment, the partition element is inclined with respect to the bottom of the detergent compartment in the first position. This means that in the first position the principal axis of the partition element (which is perpendicular to the horizontal pivoting axis) is not perpendicular to the bottom surface area of the detergent compartment in the region of the partition element. Preferably the angle of inclination is within a range from 10° to 88°, or from 15° to 78°, or from 20° to 68° (the inclination angle is taken between the principal axis of the partition element and the bottom plane of the detergent compartment, preferably the center plane of the bottom of the detergent compartment in the area of the partition element). The inclination is such that the partition element is inclined towards the outflow of the detergent compartment. Thereby the partition element can only be pivoted in one direction from the first position to the second position. The pivoting range of the partition element starting from the first position is running through the partial compartment. This has the effect, that if the partition element is in its first position and liquid detergent is filled into the partial compartment, the pressure of the liquid detergent additionally presses onto the partition element and holds it in its closed position by pressing it against the bottom surface of the detergent compartment. No additional rest or stop element is required within the detergent compartment to hold the partition element closed in its first position when liquid detergent is filled in.

According to a preferred embodiment, in the second position the partition element rests on a rest element, wherein the rest element is arranged at the detergent compartment. Preferably the partition element rests by gravity only on the rest element such that it is in stable position by gravity and does not need any fixing or blocking means to hold it in the second position.

Further, in an embodiment, when the partition element is horizontally or essentially horizontally aligned in the second position in the upper region of the detergent compartment, the partition element does not occupy the space where the detergent (powder detergent) is stored and does not form a barrier in the flow path of the detergent/water mixture.

Preferably the partition element can be freely swung or rotated from the first to the second position without a frictional or resting barrier in its path of rotation that has to be overcome. In this case, the user can easily and without using force swing the partition element from the first to second position and vice versa. Additionally, no lock element extending into or formed at detergent compartment is required for holding the partition element in its first and/or second position.

According to a preferred embodiment, the partition element has an overflow edge representing a well-defined overflow area for the liquid detergent (or water or a mixture thereof) when the partition element is in its first position. So by appropriately setting the overflow edge at a predefined position or region of the partition element, the paths of the overflowing liquid can be confined to a convenient area within the detergent compartment behind the partial compartment. Preferably the overflow edge confining the overflow is a window, a valley, a depression, a V-shaped or a U-shaped rim at the upper edge or upper area of the partition element when being in its first position. When the partition element is in its first position preferably the vertical position of the overflow edge is lower than the pivoting axis and thus lower than the pivot bearing of the partition element. Thus clocking of the pivot bearing by liquid detergent is avoided as always the maximum liquid level is below the vertical height of the pivot bearing.

According to a preferred embodiment, user information is provided on a first side of the partition element and/or a second user information is provided on a second side of the partition element, wherein the first user information can be read when the partition element is in its first position and/or the second user information can be read when the partition element is in its second position. For example, user instructions can be provided as to how to move the partition element from the first to the second position or vice versa and/or what type of detergent can be used in the respective position of the partition element and/or to which level the liquid detergent is to be filled.

Preferably in the first position the first side of the partition element faces towards the upper opening of the detergent compartment and in the second position the second side of the partition element faces towards the upper opening of the detergent compartment. Facing the upper opening of the detergent compartment does not necessarily mean that the surface of the partition element is parallel to the upper opening area, but at least the respective side of the partition element can be viewed through the upper opening of the detergent compartment. In case of a drawer of a washing machine or a dryer for example the first side can be seen by the user when the partition element is in its first position and the second side can be seen when the partition element is in its second position.

In a preferred embodiment the pivoting angle between the first and second position is equal to or more than 180°, preferably more than 200°, 230° or more than 260°.

In the following a second version of a home appliance according to an aspect of the invention is described, wherein the partition element has a single pivot rest. The general comments relating to the above described first version of the home appliance having the partition element with the horizontal element correspondingly applies for this second version.

In the second version, a single pivot rest is arranged at the bottom of the detergent compartment and the partition element is pivotally supported at the single pivot rest only. In an embodiment, the pivot rest provides the pivot bearing and at the same time provides the only mounting connection between the partition element and the detergent compartment. Thus a partition element easy to use and easy to mount is provided, requiring a reduced number of elements for mounting.

According to a preferred embodiment, either the partition element or the detergent compartment has a protruding pivot pin that, when the partition element is mounted in the detergent compartment, is received within a pivot hole or pivot recess of the detergent compartment or partition element, respectively. Preferably and when the pivot pin is inserted into the pivot hole or pivot recess, a lock or connection or a catch connection is formed between the two elements, such that the partition element is securely mounted at the detergent compartment.

According to a further embodiment the hole or recess and the pivot pin are elastically biased with respect to each other such that a minimum torque is required to rotate the partition element. By this elastic bias resulting in a rotation friction, the partition element is held in the angular alignment selected by the user. For example when the user rotates the partition element into the first position, the partition element will not further turn, for example when filling in liquid detergent or when the detergent compartment is moved (e.g. by pulling and pushing the detergent drawer).

Preferably no notch or any other barrier element is provided at the detergent compartments surface which forms a barrier to the free rotation of the partition element (except the above mentioned frictional force by the elastic bias). Thus it is easy for the user to rotate the partition element and no singular resistance has to be overcome when rotating the partition element.

In the following, embodiments are described that are applicable as preferred embodiments for the first and second version of the home appliance having the partition element:

In a preferred embodiment, the lower profile of the partition element (in particular the lower profile of the partition element when it is in its first position) mates with the surface profile of the detergent compartment when the partition element is its first position. Mating means that there is no gap or only a small gap between the lower edge of the partition element and the upper inner surface of the compartment in the range of the lower edge of the partition element when being in its first position.

Preferably in a further embodiment thereof, at least a water gap and/or water channels are provided between the detergent compartment and the partition element when the partition element is in its first position. Thereby it is possible, that after flushing the liquid detergent to the outlet of the detergent compartment, the water can gradually escape and flow to the outlet. Thereby the water that is otherwise dammed by the partition element in its first position is slowly and finally drained and new liquid detergent can be poured into the partial compartment for the next washing cycle.

Preferably the water gap and/or the water channels are such that the liquid detergent having a higher viscosity and/or small solid particles in it (emulsion) can not flow through the water gap or have a negligible leak through the water gap. Thereby it is prevented that liquid detergent flows to the outlet at a time before the liquid detergent is required for the respective washing step.

BRIEF DESCRIPTION OF THE DRAWINGS

In the following detailed embodiments of the invention are described under reference to the accompanying figures. The figures show.

DETAILED DESCRIPTION OF EXEMPLARY EMBODIMENTS

Figure 1:
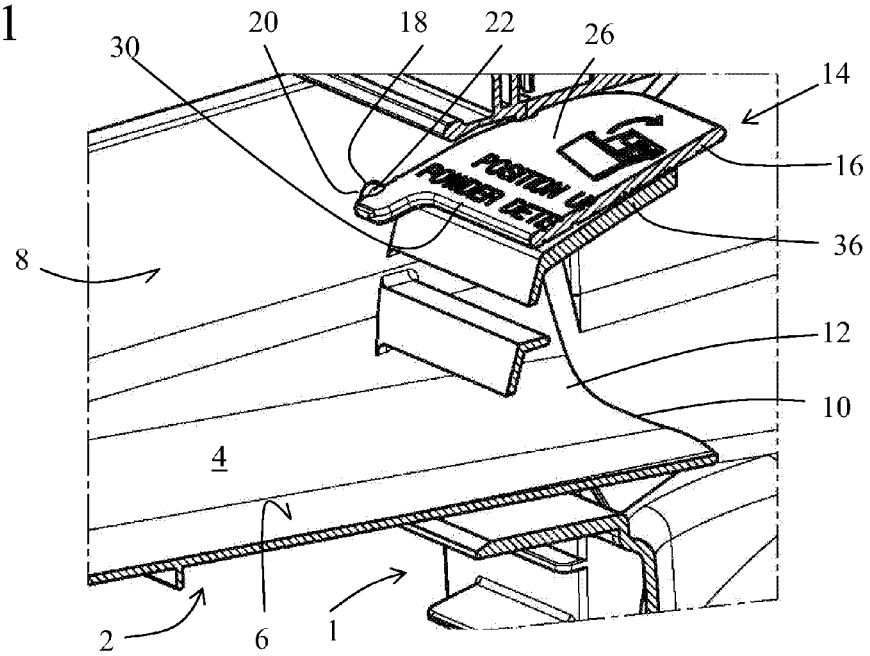
FIG. 1 a partial view in cross-section of a drawer in a washing machine.
Figure 2:
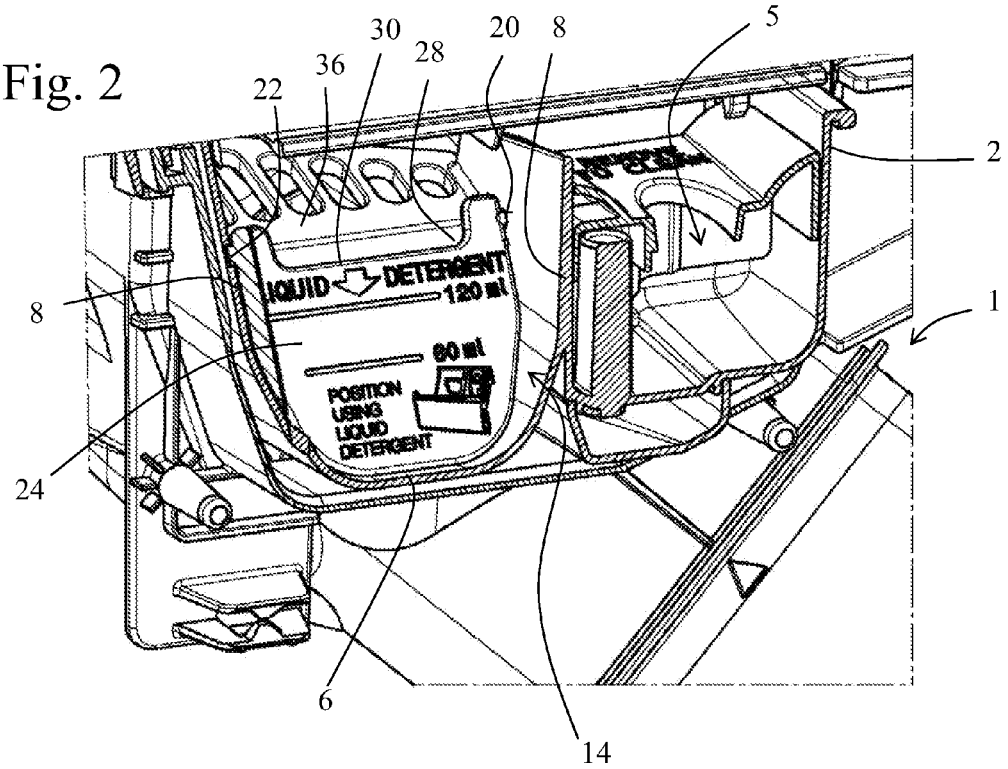
FIG. 2 a partial view in cross-section from another perspective of the detergent drawer in FIG. 1, FIG. 3 a cross-section in longitudinal direction through the drawer shown in FIG. 1, wherein a flap is in a first position, FIG. 4 the cross-section view of FIG. 3, wherein the flap is turned to a second position as compared to FIG. 3, FIG. 5 another embodiment of a drawer partially drawn out of a washing machine in partial perspective view, with a shutter at a second position, FIG. 6 a partial cross-sectional view of the drawer of FIG. 5 with the shutter turned to a first position as compared to FIG. 5, and FIG. 7 a cross-sectional view taken along the longitudinal axis of the drawer shown in FIG. 5.

FIG. 1 shows a partial cross-sectional view of a drawer 2 pulled out of a washing machine body 1 which is partially shown only. The cross-section of drawer 2 shown in FIG. 2 is taken perpendicular to the longitudinal axis of the drawer, i.e. perpendicular to the push/pull-direction of the drawer 2. As shown in FIG. 2, the drawer 2 has a detergent compartment 4 at the left side and a softener compartment 5 at the right side. A bottom wall 6 of the detergent compartment 4 is inclined downwards towards an outlet opening 12 at the rear side of the drawer 2 (see longitudinal section in FIG. 3). When the drawer 2 is completely pushed into the washing machine body 1 the detergent that is stored in the detergent compartment 4 is washed out of the detergent compartment 4 towards the outlet opening 12 by spraying or pouring water from the upper side of the washing machines body 1 into the feeding opening 32 of the compartment 4. The water/detergent mixture is flowing out of the detergent compartment 4 at a rear edge 10 and from there through flow channels into the tub of the washing machine (not shown).

A pivotable flap 14 is provided within the detergent compartment 4 which can be swung around a horizontal axis. As can be seen from FIG. 2, the horizontal axis is the line between two hinges 18 arranged at both side walls 8 of the detergent compartment 4. Each hinge 18 is formed by a hole 20 in the side wall 8 and a pin 22 protruding from both lateral sides of the flap 14. The pins 22 are inserted each in one of the holes 20 and the pivoting axis (the line between the two hinges 18) is essentially perpendicular to the longitudinal or push/pull direction of the drawer 2. The flap 14 is substantially formed by a partition wall 16 that has a first side 24 and a second side 26.

Figure 3:
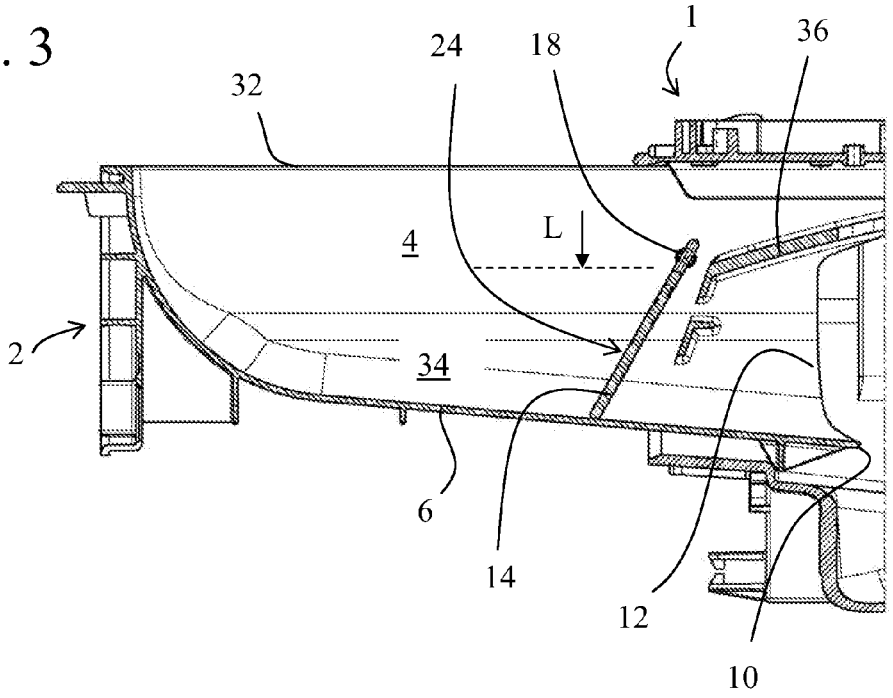

FIG. 3 shows the flap 14 being positioned in a first position in which the first side 24 is pointing to the upper front direction of the washing machine. Thus, the flap 14 being in the first position, a user can read user information shown on the first side 24 when the drawer 2 is pulled out of the washing machine's body 1. In the first position the contour of the lower edge of flap 14 mates or nearly mates (see below) with the bottom and side walls' surface contour of the detergent compartment 4 in the area of the flap's edges when the flap is in the first position. FIG. 2 shows the flap in its first position and mating of the detergent compartment inner contour with the lower edge of the flap can be seen therefrom.

In the first position the detergent compartment 4 is reduced in its storing volume and a liquid partial compartment 34 is formed. Referring to FIG. 3, a liquid detergent can be filled via the feeding opening 32 into the liquid partial compartment 34 up to an overflow level L as indicated by the arrow in FIG. 3. When using the detergent compartment 4 for liquid detergent, the flap is in its first position and when the drawer 2 is completely inserted into the washing machine body 1, water supplied from above through feeding opening 32 into the liquid partial compartment results in a rising liquid level above maximum overflow level L. When the overflow level L is reached or exceeded, the liquid from the liquid partial compartment 34 flows over an overflow edge 30 of an overflow window 28 formed in the flap 14.

In the first position, the overflow edge 30 is located vertically lower than the hinges 18 (i.e. the horizontal pivot axis). Thus the liquid level within the liquid partial compartment 34 does not reach the vertical height of the hinges 18 and no liquid detergent can clog the hinges 18 or holes 20 and also no liquid can leak out of the side walls at the holes 20.

As indicated above, even though the contour of the lower edge of the partition wall 16 mates to the contour of the inner surfaces of the detergent compartment 4, there is no watertight sealing and an intentional gap or tolerance is provided such that water can flow through the gap which forms a small predetermined leakage. The water gap is designed such that the liquid detergent having higher viscosity and/or particles (like an emulsion) is prevented from flowing through the water gap. On the other hand, if—after washing the liquid detergent out of the liquid partial compartment 34 by pouring in water into the liquid partial compartment 34—nearly pure and undiluted water remains, then the water can slowly leak through the water gap between the flap 14 and the detergent compartment's inner wall surface.

As shown in FIG. 3, the flap 14 is inclined in its first position relative to the bottom surface of bottom wall 6 in compartment 4, such that the flap 14 is held in its position by gravity. In the example of FIG. 3, the angle of inclination is about 25°. No extra rest, ledge or other securing means is required to hold the flap 14 in its first position. Additionally, as soon as the liquid detergent is poured into the liquid partial compartment 34, the liquid pressure of the liquid detergent assists in keeping flap closed in the first position.

Figure 4:
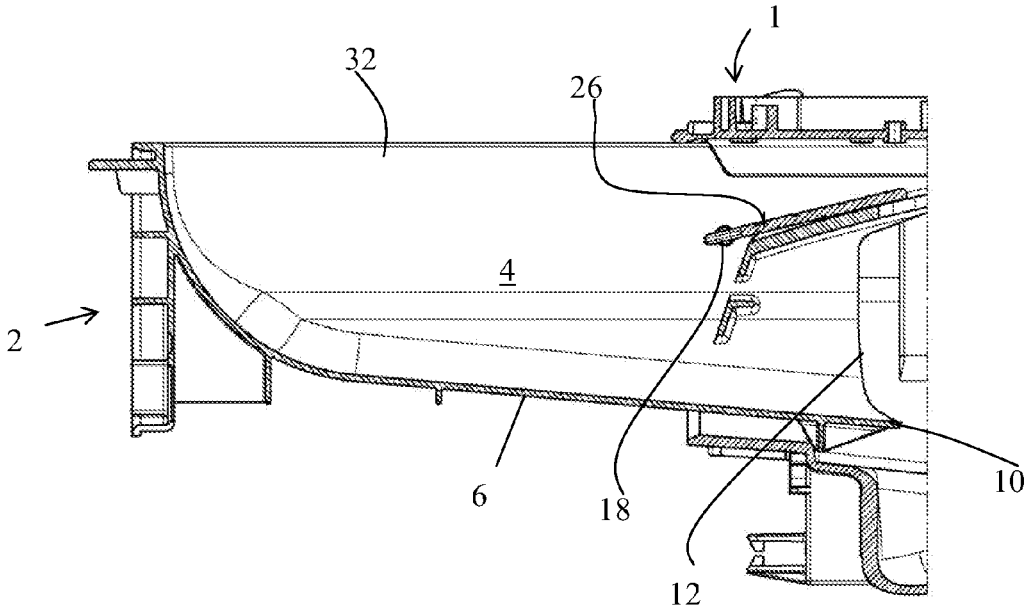

FIG. 4 shows the cross-section of the drawer 2 along the lateral direction of the detergent compartment 4 (as in FIG. 3). The flap 14 as shown here in its second position where the flap rests by gravity on a transverse element 36 which is conventionally provided in the detergent compartment 4. So also for holding the flap 14 in its second position, no extra rest or ledge or any other securing means is required to hold flap 14 in the second position.

As can be seen from FIG. 1, the second side 26 of the flap 14 can be read by the user when the drawer 2 is pulled out of the washing machine body 1. Thus user instructions can be provided at the second side 26, for example how the flap has to be swung to the first position when the detergent compartment 4 is to be used for liquid detergent. Generally in the second position of the flap 14, the detergent compartment 4 can be used for solid or powder detergent.

Figure 5:
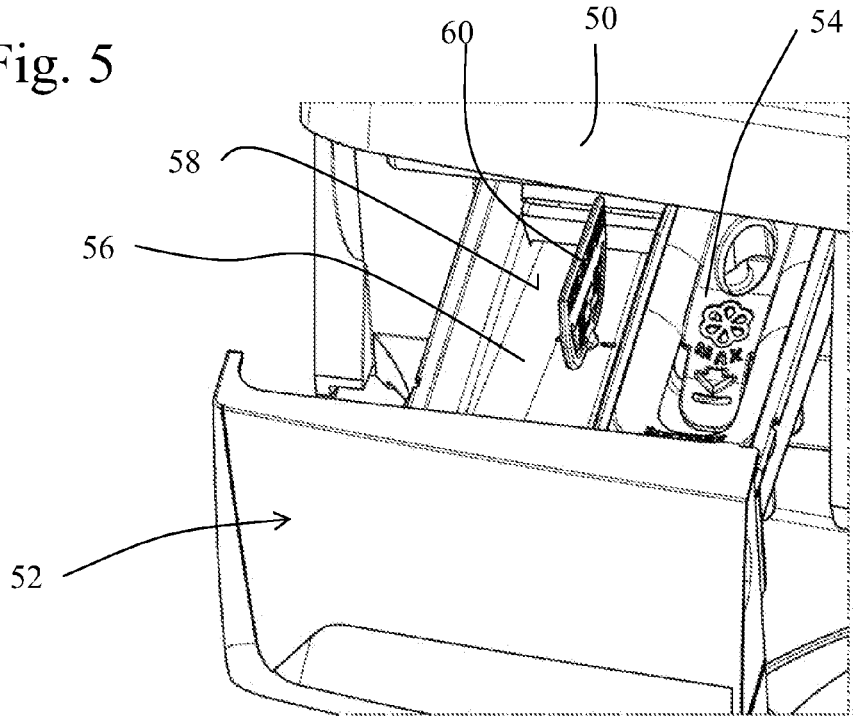

FIG. 5 shows a perspective partial view onto a washing machine body 50 having a partially pulled-out drawer 52 according to a second embodiment or version. As in the first embodiment or version described above, the drawer 52 has a softener compartment 54 and a detergent compartment 56, the latter one being designed for using powder or solid o detergent. As in the first embodiment, the detergent compartment 56 can be converted into a liquid partial compartment 68 for storing a liquid detergent. In this case the liquid partial compartment 68 is separated by a pivotable shutter 60 that can be rotated around a vertical pivot axis or nearly vertical pivot axis. The pivoting axis of the pivotable shutter or partition element may be vertical substantially vertical or within an inclination range of ±20° to the vertical, preferably in an inclination range of ±10°, ±5° to the vertical.

Figure 6:
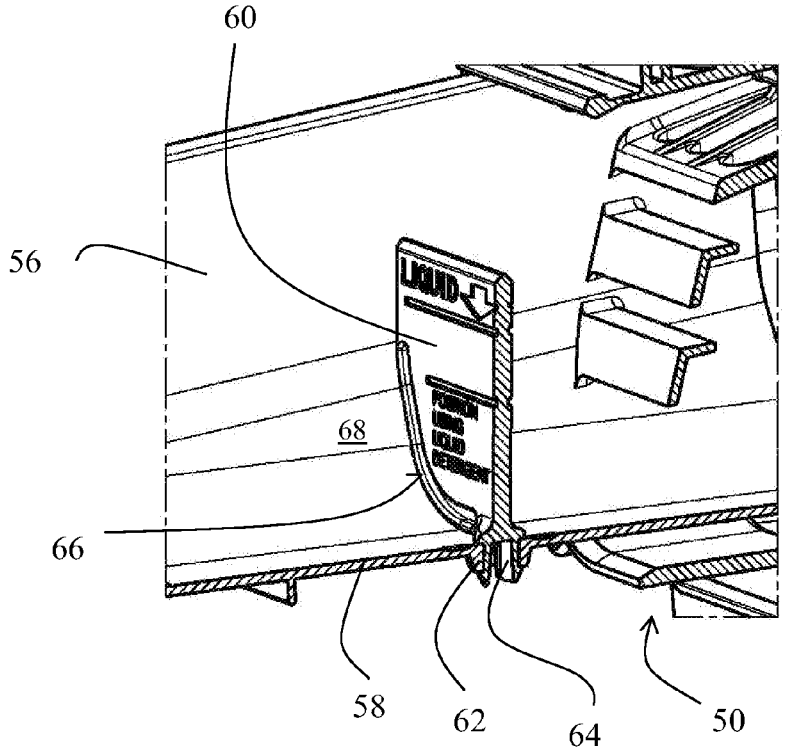
Figure 7:
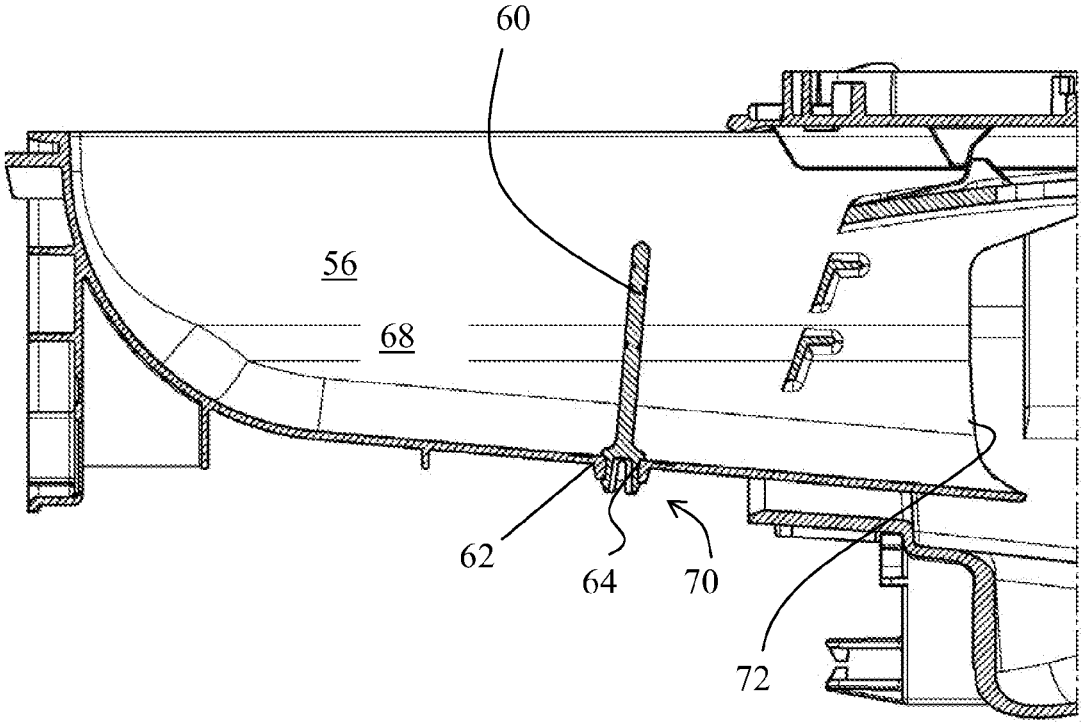

FIG. 5 shows the shutter 60 in an open position such that the detergent compartment 56 can be used for powder detergent. FIGS. 6 and 7 show the shutter 60 in a first position in which the liquid partial compartment 68 is separated by the shutter 60 from an outlet opening 72 (see above outlet opening 12) of the detergent compartment 56. At the lower edge 66 of the shutter 60 a stud 64 is protruding vertically downwards and the stud 64 is inserted into a hole 62 formed in a bottom wall 58 of the detergent compartment 56. When the stud 64 is completely inserted into the hole 62, a snap fit connection 70 is formed between stud 64 and hole 62. The snap-fit 70 prevents an easy removal of the shutter 60 but enables a rotation of the shutter 60 around the vertical or nearly vertical axis. The stud 64 has a hollow cylindrical form and when inserted into the hole 62 the outer walls of the stud 64 exert a radial bias against the inner walls of the hole 62 such that a liquid sealing is provided thereby.

In use and as shown in FIG. 6, user instructions are provided on one or both side surfaces of the shutter 60. In the showed example different liquid detergent levels are indicated such that the user sees the convenient amount of liquid detergent to be filled in when the shutter 60 is in its first (closed) position.

As mentioned above for the first embodiment, the lower edge 66 of the shutter 60 mates with the inner surface of the detergent compartment 56 in the area of the shutter 60 when being in its first position. Preferably again a water leakage or water gap is provided in the first position of the shutter 60, such that after washing the liquid detergent into the tub of the washing machine a small and predefined water leak is provided such that the liquid partial compartment 68 is emptied over time by water leakage and no water will remain in the liquid partial compartment 68. On the other hand the liquid detergent is confined to the liquid partial compartment 68 and leakage through the water gap is prevented or reduced to nearly zero.

REFERENCE NUMERAL LIST

L overflow level
1 washing machine body
2 drawer
4 detergent compartment
5 softener compartment
6 bottom wall
8 side wall
10 rear edge
12 outlet opening
14 flap
16 partition wall
18 hinge
20 hole
22 pin
24 first side
26 second side
28 overflow window
30 overflow edge
32 feeding opening
34 liquid partial compartment
36 transverse element
50 washing machine body
52 drawer
54 softener compartment
56 detergent compartment
58 bottom wall
60 shutter
62 hole
64 stud
66 edge
68 liquid partial compartment
70 snap-fit
72 outlet opening

The invention claimed is:

1. A home appliance, in particular washing and/or drying machine, comprising:

a detergent feeding device having a detergent compartment for storing a detergent, the detergent compartment comprising an outlet; and a pivoted partition element arranged in the detergent compartment, the partition element being supported pivotable at a horizontal or essentially horizontal axis, wherein:

in a first position the partition element separates a partial compartment in the detergent compartment from the outlet, for storing an amount of liquid detergent in the partial compartment;

wherein in a second position the partition element provides passage from the partial compartment to the outlet; and in the first position the partition element is inclined with respect to a bottom of the detergent compartment toward the outlet, such that from the first position the partition element can be pivoted to the second position only in one pivoting direction, away from said outlet; and the pivoting path of a partition portion of the partition element is partially situated in the partial compartment, whereby a pressure of a liquid detergent filling the partial compartment will press the partition portion against said bottom to hold it in the first position.

2. A home appliance according to claim 1, wherein in the second position the partition element rests on a transverse connection element running between lateral walls of the detergent compartment.

3. A home appliance according to claim 1, wherein the partition element can be freely pivoted from the first to the second position, without needing to overcome a frictional or resting barrier.

4. A home appliance according to claim 1, wherein the partition element comprises an overflow edge operable in the first position for confining overflow from the partial compartment to the outlet to a predefined region of the partition element's upper region.

5. A home appliance according to claim 4, wherein in the first position the overflow edge is lower than said horizontal or essentially horizontal axis.

6. A home appliance according to claim 1, wherein in the first position a first side of the partition element is facing towards an upper opening of the detergent compartment and wherein in the second position of the partition element a second side of the partition element is facing towards the upper opening of the detergent compartment.

7. A home appliance according to claim 1, wherein a lower profile of the partition element is adapted to the bottom and lateral profile of the detergent compartment such that there is no gap or only a small gap between the partition element and the detergent compartment bottom and lateral walls when the partition element is in its first position.

8. A home appliance according to claim 1, wherein in the first position a water gap is, and/or water channels are, provided between the detergent compartment and the partition element, in particular between at least a portion of the bottom of the detergent compartment and a lower edge of the partition element.

9. A home appliance according to claim 1, wherein in the second position the partition element rests on a rest element of the detergent compartment and the partition element is horizontally or essentially horizontally oriented on the rest element.

* * * * *